US006026604A

United States Patent [19]

Turos

[11] Patent Number: 6,026,604

[45] **Date of Patent: *Feb. 22, 2000**

[54] ARTICLE OF DISPLAY REMOVABLY ATTACHABLE TO AN OBJECT

[76] Inventor: Kenneth Turos, P. O. Box 13207, Albuquerque, N.Mex. 87192

[ * ] Notice: This patent issued on a continued prosecution application filed under 37 CFR 1.53(d), and is subject to the twenty year patent term provisions of 35 U.S.C. 154(a)(2).

[21] Appl. No.: 08/858,784

[22] Filed: May 19, 1997

[51] Int. Cl.[7] ..... G09F 3/12

[52] U.S. Cl. ..... 40/668; 441/451

[58] Field of Search ..... 40/668, 451; 441/451, 441/456

[56] References Cited

U.S. PATENT DOCUMENTS

| | | | |
|---|---|---|---|
| 1,906,527 | 5/1933 | Bradley | 441/451 |
| 3,009,381 | 1/1961 | Rapata | 40/668 |

*Primary Examiner*—Cassandra H. Davis
*Attorney, Agent, or Firm*—Ray R. Regan

[57] ABSTRACT

An article of display removably attachable to an object includes a base having an outer surface and an inner surface. Two or more rods each having a proximal end and a tapered distal end are mounted on the inner surface of the base. One or more notches may be formed in each rod. Each notch is disposed between the proximal end and the tapered distal end of each rod. The article of display is attached to an object by applying pressure against the outer surface of the base.

13 Claims, 2 Drawing Sheets

ARTICLE OF DISPLAY REMOVABLY ATTACHABLE TO AN OBJECT

This application is a continuation of U.S. application Ser. No. 08/858,784 filed on May 19, 1997.

CROSS-REFERENCE TO RELATED APPLICATION

None.

FEDERALLY SPONSORED RESEARCH AND DEVELOPMENT

None.

FIELD OF THE INVENTION

The present invention pertains generally to articles of displays. More particularly, the present invention pertains to a decorative article of display which is removably attachable to an object on which the decorative display is exhibited. The present invention is particularly, but not exclusively, useful for removably attaching decorative displays securely to a variety of items including, but not limited to, heels of shoes; heels of boots; soles, heels and bodies of footwear and athletic footwear; head gear; belts; brief cases and travel containers; athletic gear and many other items.

BACKGROUND OF THE INVENTION

Numerous decorative articles of display are known. Devices and methods for displaying one or more letters of the alphabet, initials, words, combinations of word and symbols, symbols, logos, crests and a variety of insignia, decorations and appliques, and a variety of other shapes and configurations (collectively, "articles of display") are well known by persons skilled in the art. However, many apparatus and methods currently available as articles of display must be permanently installed on the object to which the articles of display are attached, or on which the articles of display are mounted. Further, many articles of display and display devices currently available require the user of the article of display, as a predicate to enabling attachment, to deform, alter, or modify the object on which the article of display is to be attached. The concomitant is equally true: many articles of display presently available require the user of the article of display to deform, alter, or modify the article of display itself as a predicate to attaching or mounting the article of display on an object. Because either the article of display, or the object on which the article of display is to be attached, must be deformed or modified to enable the attachment, the currently available articles of display often cannot be detached and reused, or require repair of the object on which the article of display has been attached.

In addition, many existing articles of displays are comprised of a multiplicity of interactive and inter-cooperating elements and mechanisms requiring the user to manipulate those elements and mechanisms if the user wants to create a new or modified article of display for installation on an object. Further, serious limiting factors for use of existing articles of display include the high costs and expenses associated with manufacturing decorative articles of displays. The costs often result from a multiplicity of interlocking and associated mechanical elements required to modify or change the appearance of the article of display, or in providing one or more backings, laminations, and hand crafted components for the article of display which are difficult to manipulate, implement, are time-consuming, and are permanent or semi-permanent in nature.

Further, many current articles of display, when mounted on an object, are not securely attached to the object. Conventional articles of display may rotate, sag, loosen themselves from the object, or disengage from the object due to compressive forces, inadvertent contact by the user, and similar forces.

What is needed, therefore, is an article of display which is securely but removably attachable to an object on which the article of display will appear, is relatively inexpensive to manufacture, does not deform the object on which the article of display will be mounted, does not require deformation of the article of display to enable attachment of the article of display to the object on which the article of display is to be mounted or attached, and may be readily and easily removed from the object if the article of display no longer is desired, for repair of the article of display, for substitution of a different article of display, or for any other reason.

In light of the above, it is an object of the present invention to provide an article of display which is removably attachable to an object on which the article of display is mounted.

It is another object of the present invention to provide a removably attachable article of display which does not, on being attached to an object, deform, alter, or modify the object on which the article of display is attached.

It is yet another object of the present invention to provide a removably attachable article of display which does not, to enable attachment to an object, require that the article of display be deformed, altered, or modified.

Yet another object of the present invention to provide a removably attachable article of display which does not require a planar surface on the object to which the article of display is to be attached, but may be attached to a nonplanar surface as well as a planar surface.

Another object of the present invention is to provide a removably attachable article of display which, because neither the article of display, nor the object on which the article of display is mounted, must be deformed, altered or modified, with the result that the article of display is reusable.

Still another object of the present invention to provide a removably attachable article of display which requires no lamination process or applique process to create the article of display, and requires no adhesives to create.

Still another object of the present invention to provide a removably attachable article of display which may be manufactured not only of metal, but also of plastics, resins, nylons and any other synthetic materials, and whose construction may be either rigid, ductile, malleable, or flexible. The article of display, therefore, may be made of zinc which may also be coated with gold.

Yet another object of the present invention is to provide an article of display which is removably attachable to an object, and a method for manufacturing such an article of display which is removably attachable to an object, which is easy to use and to practice, is readily and easily installed by the user at the point of sale or elsewhere, and which is cost effective for the intended purposes.

These and other objects, features, and advantages of an article of display which is removably attachable to an object, will become apparent to those skilled in the art when read in (conjunction with the accompanying following detailed description, drawing figures and appended claims.

SUMMARY OF THE INVENTION

An article of display removably attachable to an object, according to the present invention, includes a base. The base may be formed, by way of example but not of limitation, in the shape or shapes of one or more letters of the alphabet, initials, words, combinations of word and symbols, symbols, logos, crests and a variety of insignia, decorations and appliques, and any other shapes and configurations (collectively, "article of display"). The base is formed to include an outer surface and an inner surface. Fully assembled as an article of display, and mounted on an object according to the present invention, the inner surface of the base faces the object on which the article of display is mounted or attached. Fully assembled as the removably attachable article of display, and mounted on an object, according to the present invention, the outer surface of the base is directed away from an object on which the article of display is mounted or attached. At least one point of the inner surface of the base, when fully assembled as an article of display and attached to an object, may be in contact with the exterior plane of the object on which the article of display is attached.

An article of display removably attachable to an object, according to the present invention, also includes two or more rods. Each of the two or more rods has a distal end and a proximal end. The distal end of a rod is tapered. Neither the length, shape, or material used in connection with the two or more rods is a limitation of the present invention. Therefore, while the accompanying drawing shows two or more rods which are substantially cylindrical, the cross-section of the two or more rods could be any number of geometric configurations. One or more notches may be formed in the two or more rods. Each of the one or more notches may be disposed between the proximal end of the rod and the tapered distal end of the two or more rods. Neither the precise location, direction, depth, shape, course or distance of the one or more notches is a limitation on the present invention. Thus, the one or more notches which may be formed in the two or more rods may be along the longitudinal access of the two or more rods, or circumferentially radially disposed on the two or more rods, or partially radially formed in the two or more rods, or in any other location, course or distance in and on the two or more rods. The one or more notches need not be formed in or located on the two or more rods in the same or consistent relative position between the proximal end of two or more rods and the distal end of two or more rods.

The proximal end of the two or more rods of the article of display which is removably attachable to an object, according to the present invention, is mounted permanently on the inner surface of the base. The angle between the inner surface of the base, and the longitudinal axis of the two or more rods attached to the inner surface of the base, is not material to, or a limitation of, the present invention.

The article of display, according to the present invention, is attached to an object by applying pressure to the outer surface of the base while the tapered end of the two or more rods is adjacent the exterior plane of the object on which the article of display is to be attached. The article of display may be removably attached to the exterior plane of the object on which the article of display is to be attached. Thus, for example, the article of display removably attachable to an object may be formed as initial or alphabetical letter which, by use of applied pressure on the outer surface of the alphabetical letter, may be mounted on, for example, a boot heel using either finger pressure or applied pressure using, for example, a hammer or mallet. When attached to the object, the article of display, having two or more rods, provides for a secure, nonrotatable, nonemergent article of display.

An alternate embodiment of an article of display removably attachable to an object, according to the present invention, includes two or more rods having one or more barbs formed on the two or more rods disposed between the proximal end of the rod and the tapered distal end of the rod. The one or more barbs may by in addition to, or as an alternative to, the one or more notches formed in the two or more rods of the present invention.

Another alternate embodiment of an article of display removably attachable to an object, according to the present invention, includes one or more keepers engageable with the two or more rods, for securing the article of display on an object. After pressure is applied to the outer surface of the base of the article of display while the tapered end of the two or more rods is adjacent the exterior plane of the object on which the display device is to be attached, and the two or more rods penetrates the object on which the article of display is attached, the one or more keepers may be engaged with the two or more rods to secure the article of display on the object.

These and other objects, features, and advantages of such an article of display removably attachable to an object will become apparent to those skilled in the art when read in conjunction with the accompanying following detailed description, drawing figures, and appended claims.

The novel features of this invention, and the invention itself, both as to structure and operation, are best understood from the accompanying drawing, considered in connection with the accompanying description of the drawing, in which similar reference characters refer to similar parts, and in which:

DESCRIPTION OF THE PREFERRED EMBODIMENTS

Figure 1:
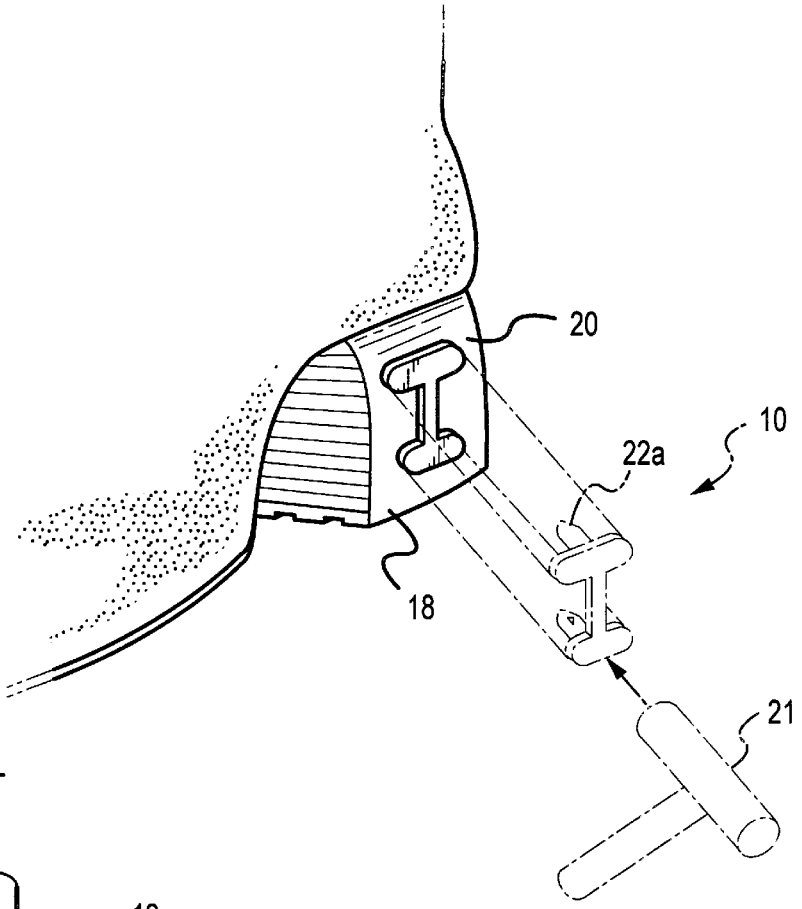
FIG. 1 is a partial side isometric perspective view of the article of display removably attachable to an object before and after the article of display is mounted on an object which in FIG. 1 is a boot and further disclosing a mallet that may be used to apply pressure to the article of display to assist in attaching the article of display to an object heel.
Figure 2:
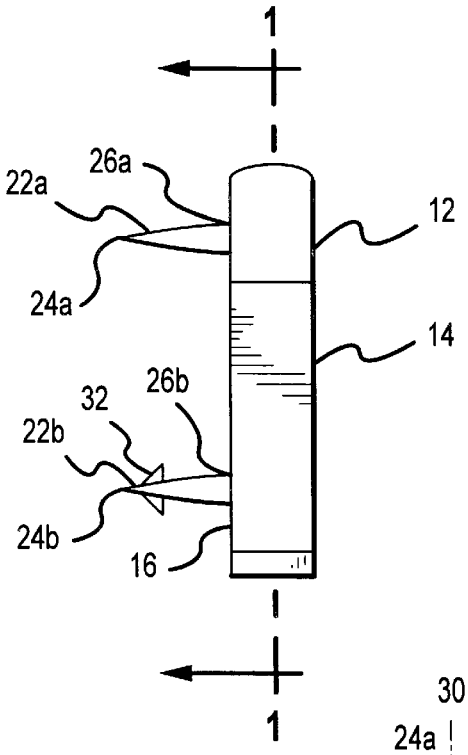
FIG. 2 is a side view of the article of display along the line 1—1 of FIG. 3.

Referring initially to FIG. 1, the article of display removably attachable to an object is shown and generally designated 10. As shown perhaps more clearly in cross-reference between FIGS. 2 and 3, article of display removably attachable to an object 10 includes a base 12. Base 12 may be formed, as an example but not of limitation, in the shape of one or more letters of the alphabet, initials, words, combinations of word and symbols, symbols, logos, crests and a variety of insignia, decorations and appliques, and any other shapes and configurations (collectively, "article of display"). As shown in FIG. 2, base 12 is formed to include an outer surface 14 and an inner surface 16. Fully assembled as an article of display 10, according to the present invention, inner surface 16 of base 12 faces the object 18 on which article of display 10 is mounted or attached. At least one point of inner surface 16 of base 12, fully assembled as article of display 10 and attached to object 18, may be in contact with exterior plane 20 of object 18 to which article of display 10 is attached. Fully assembled as removably attachable article of display 10 according to the present invention outer surface 14 of base 12 is directed away from exterior plane 20 of object 18 to which article of display 10 is attached.

Figure 3:
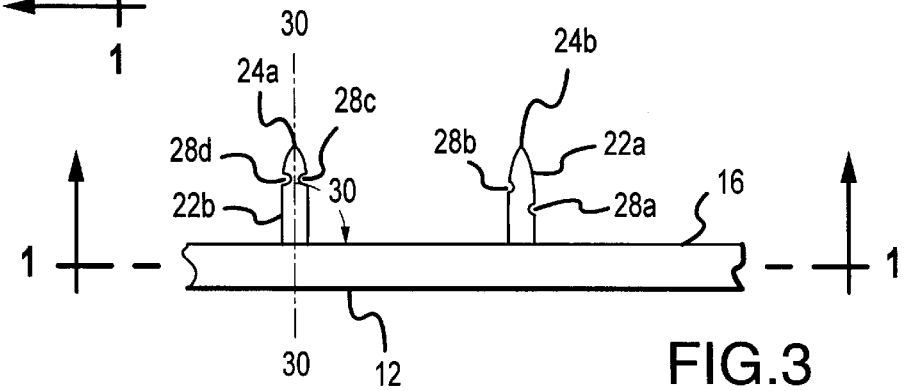
FIG. 3 is a side view of an embodiment of the article of display.
Figure 4:
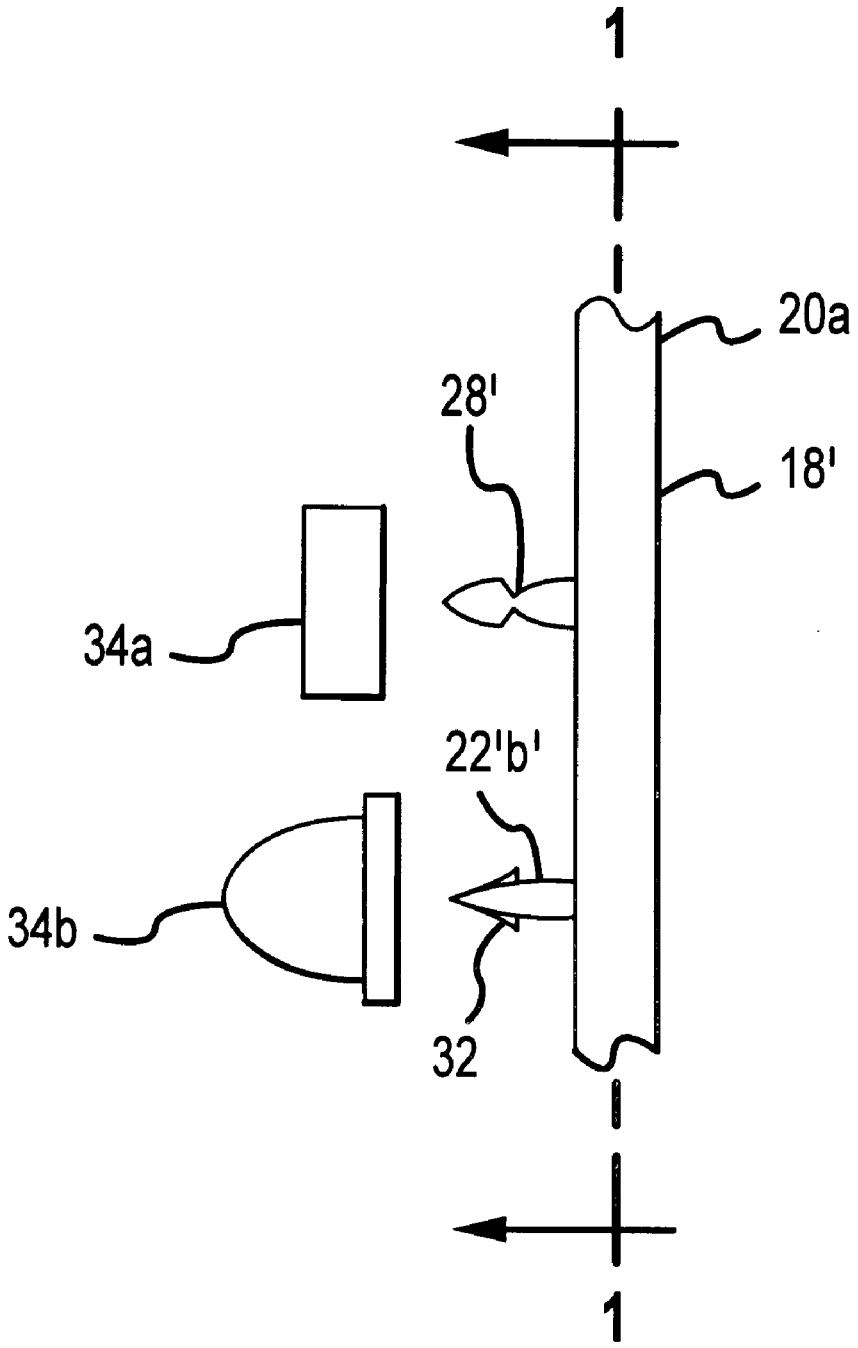
FIG. 4 is an isometric perspective view of the article of display using one or more keepers.

Article of display 10, according to the present invention, also includes two or more rods 22*a,b*. Each of the two or more rods 22 has a distal end 24*a,b* and a proximal end 26*a,b*. In accordance with the preferred embodiment of the present invention, distal end 24 of two or more rods 22 is tapered. Neither the length, shape, or material used in connection with the two or more rods 22 is a limitation of the present invention. Therefore, while the accompanying drawing shows two or more rods 22 to be substantially cylindrical, the two or more rods may be provided in any number of configurations. For many applications and uses, the two or more rods 22 may be adequate to secure yet demountably attach article of display 10 to object 18. However, as shown in FIGS. 3 and 4, one or more notches 28*a,b,c,d* may be formed in the two or more rods 22. The one or more notches 28 may be disposed between (i) proximal end 26 of two or more rods 22, and (ii) tapered distal end 24 of two or more rods 22. Neither the location, direction, depth, shape, course or distance of one or more notches 28 is a limitation on the present invention. Thus, one or more notches 28*a,b,c,d* formed in two or more rods 22 may be along the longitudinal axis 30 of two or more rods 22, or circumferentially radially disposed on two or more rods 22 shown by cross-reference between FIGS. 2 and 3, or partially radially formed in two or more rods 22, or in any other location, course or distance in and on two or more rods 22. If one or more notches 28 is formed in two or more rods 22, one or more notches 28 need not be formed in or located on two or more rods 22 in the same relative or consistent position between proximal end 26 of two or more rods 22 and distal end 24 of two or more rods 22.

As shown by cross-reference between FIGS. 2 and 3, proximal end 26 of two or more rods 22*a,b* of article of display 10 which is removably attachable to object 18, according to the present invention, is mounted permanently on inner surface 16 of base 12. The angle 30 between inner surface 16 of base 12, and longitudinal axis 30 of two or more rods 22 attached to inner surface 16 of base 12, is not material or a limitation of the present invention.

Article of display 10, according to the present invention, may be mounted on or attached to object 18, as shown in FIG. 1, by applying pressure to outer surface 14 of base 12 while tapered distal end 24*a,b* of two or more rods 22 is adjacent exterior plane 20 of object 18 on which article of display 10 is to be attached. Article of display 10 may be removably attached to exterior plane 20 of object 18 on which article of display 10 is to be attached. Thus, article of display 10 removably attachable to object 18 may be formed as initial or alphabetical letter which, by use of applied pressure on outer surface 14 of base 12 until inner surface 16 of base 12 may be in contact with exterior plane 20 of object 18 in at least one point of contact between exterior plane 20 of object 18, using either finger pressure or applied pressure in connection with, for example, a hammer or mallet 21. When attached to object 18, article of display 10, having two or more rods 22, provides for a securely attached or mounted, nonrotatable, nonemergent article of display 10.

As shown in FIG. 2, an alternate embodiment of article of display 10 removably attachable to object 18, according to the present invention, includes two or more rods 22 having one or more barbs 32 formed on two or more rods 22 disposed between proximal end 26 of rods 22 and tapered distal end 24 of rods 22. One or more barbs 34 may by in addition to, or as an alternative to, one or more notches 28 formed in two or more rods 22 of the present invention.

Another alternate embodiment of article of display 10, according to the present invention, includes one or more clutches, or keepers 34*a,b,* engageable with one or more of the the two or more rods 22'*a',b*', for securing article of display 10 on object 18' (not shown). After pressure is applied to outer surface 14 of base 12 of article of display 10 while one or more tapered ends 22 of the two or more rods 22 are adjacent exterior plane 20 of an object 18' on which display device 10 is to be attached, and two or snore rods 22'*a',b*' penetrates object 18' on which article of display 10 is attached, the one or more keepers 34*a,b* may be engaged with two or more rods 22'*a',b*' to secure article of display 10 on object 18'.

These and other objects, features, and advantages of such an article of display removably attachable to an object will become apparent to those skilled in the art when read in conjunction with the accompanying following detailed description, drawing figures, and appended claims.

While the article of display removably attachable to an object shown in the drawing figures is one embodiment of the present invention, it is merely one embodiment of the invention, is not intended to be exclusive, and is not a limitation of the present invention.

While the particular article of display removably attachable to an object as shown and disclosed in detail in this instrument is fully capable of obtaining the objects and providing the advantages stated, this disclosure is merely illustrative of the presently preferred embodiments of the invention, and no limitations are intended in connection with the details of construction, design or composition other than as provided and described in the appended claims.

What is claimed is:

1. An article of display removably attachable to an object, comprising:

a base having an outer surface and an inner surface; and two or more rods having a proximal end mounted on the inner surface of the base and a continuously tapering distal end, wherein at least one of the two or more rods is formed with one or more notches between the continuously tapering distal end and the proximal end, and wherein at least one other of the two or more rods is formed with one or more barbs between the continuously tapering distal end and the proximal end of the two or more rods.

2. An article of display removably attachable to an object as recited in claim 1, wherein the two or more rods are mounted substantially perpendicular to the inner surface of the base.

3. An article of display removably attachable to an object as recited in claim 2, wherein the base and the two or more rods are constructed of metal.

4. An article of display removably attachable to an object as recited in claim 3, wherein the base and the two or more rods are made of zinc.

5. An article of display removably attachable to an object, comprising:

a base having an outer surface and an inner surface;

two or more rods having a proximal end mounted on the inner surface of the base, and a continuously tapering distal end, wherein at least one of the two or more rods is formed with one or more notch s between the continuously tapering distal end and the proximal end, and wherein at least one other of the two or more rods is formed with one or more barbs between the continuously tapering distal end and the proximal end of the two or more rods; and means for attaching the article of display to the object.

6. An article of display removably attachable to an object as recited in claim 5, wherein the attaching means is application of pressure to the outer surface of the base to insert the two or more rods in the object.

7. An article of display removably attachable to an object as recited in claim 6, wherein the attaching means is pressure applied by a user's finger to insert the two or more rods in the object.

8. An article of display removably attachable to an object as recited in claim 6, wherein the attaching means is pressure applied by a mallet to insert the two or more rods in the object.

9. An article of display removably attachable to an object as recited in claim 5, wherein the attaching means is one or more keepers.

10. An article of display removably attachable to an object as recited in claim 5, wherein the base and the two or more rods are formed of zinc.

11. An article of display removably attachable to an object as recited in claim 10, wherein the base and the two or more rods arc formed of zinc for coating the article of display with gold.

12. An article of display removably attachable to an object as recited in claim 5, wherein the base may be formed in the shape of one or more letters of the alphabet.

13. An article of display removably attachable to an object as recited in claim 5, wherein the base may be formed in any shape.

* * * * *